US008654034B2

(12) United States Patent
Legare

(10) Patent No.: US 8,654,034 B2
(45) **Date of Patent: *Feb. 18, 2014**

(54) DYNAMICALLY RECONFIGURABLE FEED NETWORK FOR MULTI-ELEMENT PLANAR ARRAY ANTENNA

(75) Inventor: David J. Legare, Ava, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 168 days.

This patent is subject to a terminal disclaimer.

(21) Appl. No.: 13/506,402

(22) Filed: Mar. 23, 2012

(65) Prior Publication Data

US 2013/0249751 A1 Sep. 26, 2013

Related U.S. Application Data

(63) Continuation-in-part of application No. 13/385,469, filed on Jan. 24, 2012, now Pat. No. 8,605,004.

(51) Int. Cl.
*H01Q 1/50* (2006.01)
*H01Q 21/10* (2006.01)

(52) U.S. Cl.
USPC ..... 343/906; 343/745; 343/810; 343/853; 343/893

(58) Field of Classification Search
None
See application file for complete search history.

(56) References Cited

U.S. PATENT DOCUMENTS

| | | | | |
|---|---|---|---|---|
| 6,037,903 | A * | 3/2000 | Lange et al. | 343/700 MS |
| 6,087,991 | A * | 7/2000 | Kustas | 343/700 MS |
| 6,198,438 | B1 * | 3/2001 | Herd et al. | 343/700 MS |
| 7,109,929 | B1 * | 9/2006 | Ryken et al. | 343/700 MS |
| 7,868,829 | B1 * | 1/2011 | Colburn et al. | 343/700 MS |
| 8,537,059 | B2 * | 9/2013 | Sauer et al. | 343/705 |
| 2004/0227667 | A1 * | 11/2004 | Sievenpiper | 343/700 MS |
| 2005/0179614 | A1 * | 8/2005 | Nagy | 343/909 |
| 2005/0253763 | A1 * | 11/2005 | Werner et al. | 343/745 |
| 2006/0164309 | A1 * | 7/2006 | Fujishima et al. | 343/700 MS |
| 2007/0018903 | A1 * | 1/2007 | Mohamadi | 343/700 MS |
| 2013/0063325 | A1 * | 3/2013 | Legare | 343/906 |

* cited by examiner

*Primary Examiner* — Trinh Dinh
(74) *Attorney, Agent, or Firm* — Joseph A Mancini

(57) ABSTRACT

A dynamically-reconfigurable feed network antenna having a microstrip patchwork radiating surface wherein individual radiating patches and elements of a stripline feed structure can be connected to and disconnected from each other via photoconductive interconnections. Commands from software alternately turn light from light emitting sources on or off, the light or lack thereof being channeled from an underside layer of the antenna so as to enable or disable the photoconductive interconnections. The resultant connection or disconnection of the radiating patches to each other and to the stripline feed structure will vary the antenna's frequency, bandwidth, and beam pointing.

12 Claims, 5 Drawing Sheets

DYNAMICALLY RECONFIGURABLE FEED NETWORK FOR MULTI-ELEMENT PLANAR ARRAY ANTENNA

CROSS-REFERENCE TO RELATED APPLICATIONS

The present application is a continuation-in-part application of and claims priority from related, co-pending, and commonly assigned U.S. patent application Ser. No. 13/385,469 filed on Jan. 24, 2012, entitled "Dynamically Reconfigurable Microstrip Antenna System" also by David J. Legare. Accordingly, U.S. patent application Ser. No. 13/385,469 is herein incorporated by reference.

STATEMENT OF GOVERNMENT INTEREST

The invention described herein may be manufactured and used by or for the Government of the United States of America for governmental purposes without the payment of any royalty thereon.

BACKGROUND OF THE INVENTION

1. Technical Field of the Invention

This invention relates generally to the field of communications antennas. More specifically the present invention relates to reconfigurable feed networks for electronically beam-steered planar antenna structures.

2. Background

The development of antennas for use on moving platforms such as aircraft and ground vehicles has not been particularly difficult for low frequency applications where near-omnidirectional antenna beam patterns provide sufficient radio frequency (RF) gain. However, at higher frequencies an air or ground vehicle antenna must possess a degree of spatial directionality to achieve sufficient gain to close transmit and receive communications links.

Spatially-directional antennas used in air and ground vehicle applications must also have beam steering capabilities in order to maintain line-of-sight communications. Where the dynamics are not too great, beam steering on moving platforms has been accomplished by mechanically steering means. However, when dynamics are high, electronic beam phase-shift steering is the only means that will suffice.

When airborne antenna applications will have an adverse impact on aerodynamics planar, electronically phase-shift steered antennas represent the only viable solution because they afford integration into the airframe with minimal disturbance to airflow. Conformal antennas provide the ultimate solution to integration into an airframe because conformal arrays can be shaped to match portions of an aircraft such as wing leading edges. The application of multiple conformal arrays also relaxes the requirements for phase steering because at any given time the conformal array pointed being oriented nearest to boresight can be selected to carry the communications link.

Moreover, because antennas are generally designed to operate at a given relatively narrow frequency band, by design, their operational frequency range is generally fixed. Wide bandwidth antennas solve the problem of having to integrate a separate system of antenna arrays into an aircraft for each frequency band of interest. To the extent that a single antenna array can be reconfigured in real time to support multiple frequency bands of operation, the better in terms of power, weight, and space.

What is needed therefore is a communications antenna system and structure that provides real time control over electronic beam steering and operational frequency band, while possessing a simple planar structure with adaptability to conformal integration with a host platform.

3. The Prior Art

Non-patent reference to Maloney et al [1] discloses a method that addresses the physical size of antenna arrays by employing "fragmented aperture" techniques to provide controlled reception pattern antenna arrays having one-quarter the footprint of conventional arrays. Finite difference time domain code is applied to computationally model the fragmented aperture for optimization over gain, steering, bandwidth, and physical dimension. While apparently successful in reducing array size for a given bandwidth, the fragmented aperture technique does not provide the flexibility afforded by real time reconfigurability of either parameter.

Non-patent reference to Georgia Institute of Technology [2] discloses a method that apparently creates a bandwidth of 33-to-1 in a planar antenna array of given size by exploiting the properties of mutual coupling between antenna elements. However, nothing in this reference indicates that mutual coupling, and therefore bandwidth, may be varied in real time or that the mutual coupling properties are not dependent upon antenna structure planarity, so as to make amenable to conformal applications.

Non-patent reference to Syntonics, LLC entitled Pixel-Addressable Reconfigurable Conformal Antenna (PARCA Software Defined Antenna™) [3] discloses a method for dynamically adjusting the operating frequency, beamwidth, and polarization while transmitting. The PARCA™ employs movable, millimeter-scale, microstrip transmission line pixels with uniform size and dimension to create a rapidly, pixel-by-pixel, changeable antenna pattern upon command. While this reference apparently provides real time control of beam steering and bandwidth with adaptability to conformal applications, the method of operation requires the physical movement of microstrip pixels into and out of alignment with the radiating elements' plane, with no disclosed means for providing such movement.

Non-patent reference to Pringle et al [4] discloses a reconfigurable antenna array employing field effect transistors (FETs) as switches that interconnect radiating patches on the antenna's surface. To reduce control signal routing, the FETs are overlaid by a corresponding array of light emitting diodes (LEDs). The LED light illuminates a photo-detector in parallel with the gate-source junction of the FET, causing the gate source voltage to drop thereby opening the FET switch so as to connect an adjacent radiating patch. As many radiating patches as are interconnected will define the instant configuration of the antenna. While this reference represents an advancement in the state-of-the-art of reconfigurable antennas it has not overcome the necessary complexity of routing bias voltages to each and every FET, nor the associated power consumption. Additionally, the reference discloses that FET switches cause signal losses at microwave frequencies and that the metallic bias lines to each FET introduce scattering that distorts the antenna pattern.

What the prior art fails to provide and what is needed, therefore, is an antenna which (1.) is steerable and reconfigurable in terms of operating bandwidth and radiation pattern; (2.) planarized yet suitable for conformal applications; and (3.) is minimally dependent upon active circuitry and physical and electrical interconnections that create signal loss and antenna distortion.

OBJECTS AND SUMMARY OF THE INVENTION

It is therefore an object of the present invention to provide a feed network for a multi-element antenna which is electronically reconfigurable in operating frequency and bandwidth.

It is a further object of the present invention to provide a feed network for an antenna which is electronically controllable in beam shape and pointing direction.

It is still a further object of the present invention to provide a feed network that is amenable to an antenna which features a thin, planarized construction.

It is yet still a further object of the present invention to provide a feed network for an antenna meeting all of the above objectives yet is adaptable to conformal installations on air, land, and sea vehicles.

An additional object of the present invention is to overcome the complexity of prior art physical and electrical interconnections between control structures and radiating structures.

Briefly stated, the present invention achieves these and other objects by providing a reconfigurable feed network for antenna having a microstrip patchwork radiating surface wherein individual radiating patches and elements of a stripline feed structure can be connected to and disconnected from each other via photoconductive interconnections. Commands from software alternately turn light from light emitting sources on or off, the light or lack thereof being channeled from an underside layer of the antenna so as to enable or disable the photoconductive interconnections. The resultant connection or disconnection of the radiating patches to each other and to the stripline feed structure will vary the antenna's frequency, bandwidth, and beam pointing.

In a fundamental embodiment of the present invention, a feed network comprises RF feed points for connection to external signal media and a stripline feed network for connecting the external signal media to a plurality of antenna radiating elements and to tuning elements. The stripline feed network comprises a means for establishing and de-establishing electrical connectivity between the RF feed points and radiating elements, as well as between itself and any number of segments of the tuning elements. The means for establishing and de-establishing electrical connectivity is responsive to a plurality of means comprised within said control layer for producing and transmitting a control signal.

Still according to a fundamental embodiment of the present invention, a feed network comprises a means whereby a plurality of antenna radiating elements are electrically connected to a stripline feed network via conductive paths which transverse through the antenna's radiating layer and terminate at conductive patches on the stripline feed network.

The above and other objects, features and advantages of the present invention will become apparent from the following description read in conjunction with the accompanying drawings, in which like reference numerals designate the same elements.

References

[1] J. Maloney, B. Baker, J. Acree, J. Schultz, J. Little, D. Reuster, "Fragmented Aperture Antenna Design of Miniaturized GPS CRPA: Model and Measurements", pp. 3784-3787, IEEE, 2007.

[2] "100-to-1 Bandwidth: New Planar Design Allows Fabrication of Ultra Wideband Phased Array Antennas", Georgia Institute of Technology, May 9, 2006.

[3] "PARCA (Pixel-Addressable Reconfigurable Conformal Antenna)", Syntonics, LLC, http://www.syntonicscorp-.com/products/documents/Syntonics_PARCA_Narrative-Briefing.pdf

[4] L. Pringle, P. Harms, S. Blalock, G. Kiesel, E. Kuster, P. Friederich, R. Prado, J. Morris, "The GTRI Prototype Reconfigurable Aperture Antenna", pp. 683-686, IEEE, 20003.

DETAILED DESCRIPTION OF THE PREFERRED EMBODIMENT

The present invention describes the design and fabrication of a planar antenna featuring a set of microstrip elements which can be dynamically interconnected and de-interconnected so as to re-pattern the radiating structure of the antenna in order to tune it over a broad frequency band, as well as produce a wide range of beam shapes and pointing directions.

Figure 1:
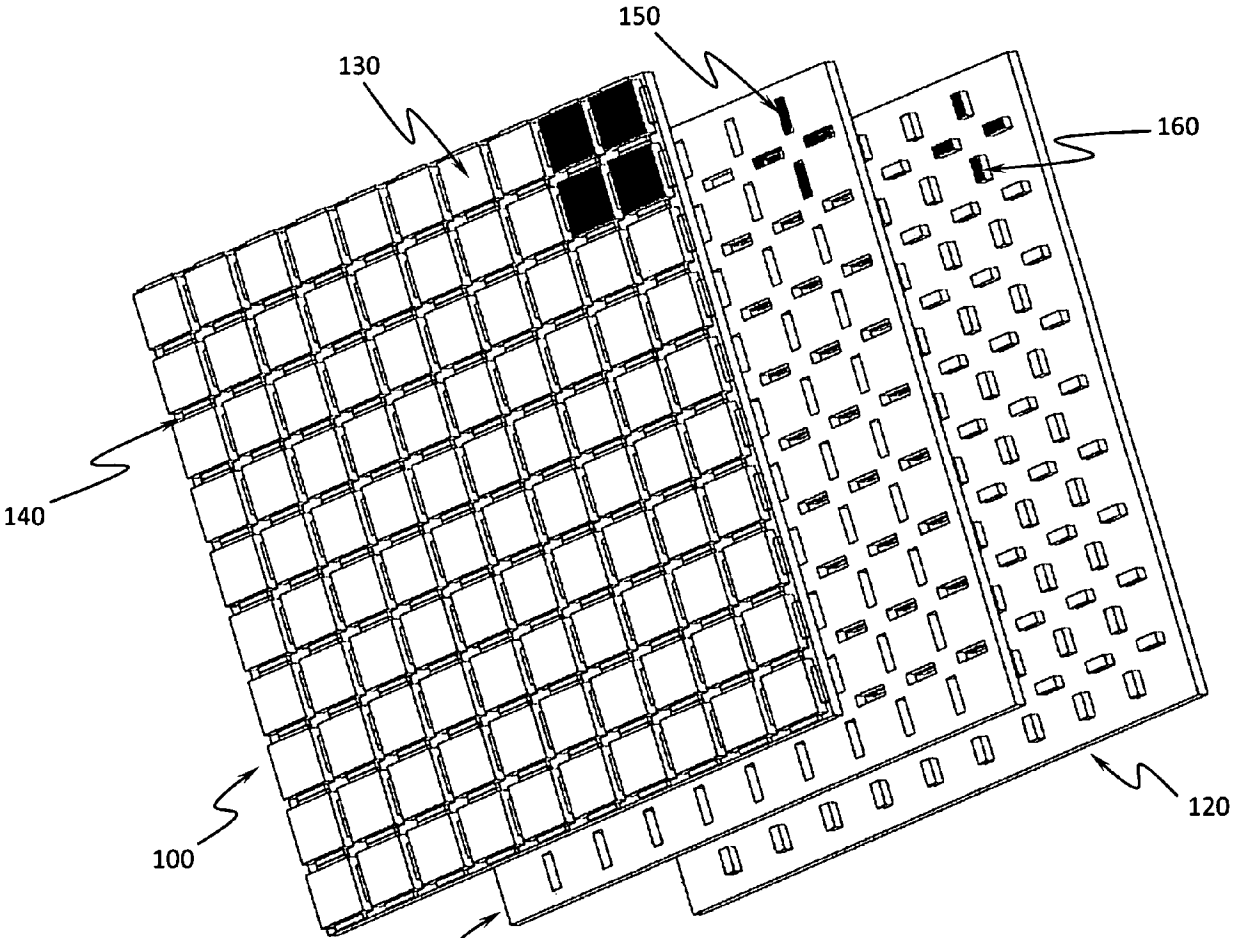
FIG. 1 depicts the three principle layers of the present invention's antenna structure as viewed from the front side radiating surface.

Referring to FIG. 1, the antenna surface 100 is uniformly covered with a dense array of individual very closely spaced electrically conductive segments or "pixels" 130 (preferably a thin metal layer and square in shape) each joined to each of its adjacent segments by a comparatively narrow (square or rectangular) photoconductive connector 140 which is in electrical contact with (or actually overlaps) any two adjacent metallic segments 130, thus filling in the narrow gap between them. Each photoconductive connector 140 is comprised of a photoconductive material made up of CdS, or some variation thereof or substitution therefore, which is optimized in chemical composition and physical structure of the connector to have a very high electrical conductivity when exposed to light, and which becomes virtually non-conductive in the absence of light. A brief literature search indicates that a dynamic range of up to $10^6$ (ie 0.1 ohm "on state" to 100K ohm "off state") is readily available with off-the shelf photoconductive material technology.

Still referring to FIG. 1, additionally, a coplanar array of light-emitting elements (LEDs or laser diodes) 160, each of whose outputs is co-aligned and confined to the area of its mating photoconductive connector 140 is closely coupled to the underside of antenna surface 100 (i.e., non-RF-emitting side). Thus, a continuous electrically conductive patch or pattern of patches (comprised of the electrically conductive metallic segments 130 joined by their adjacent photoconductive connectors 140) making up a microstrip antenna element or multiple elements, as well as associated strip lines, feeds, etc. can be created on the antenna (RF-emitting) surface 100 by activating the corresponding pattern of LED's 160 in the coplanar underside array 120. Note that the required ground plane could be placed either above or below the plane of the LED array in the coplanar underside array 120; in the former case, holes 150 would be placed in the ground plane 110 to allow the light from each LED 160 to reach its corresponding photoconductive connector 140. It would be readily perceived by one skilled in the art that even though the front side of antenna surface 100 is typically referred to as the RF-emitting side, it could also function as an RF receiver, or both emitter and receiver simultaneously.

The resolution of the conductive pattern on the antenna surface 100 will be limited by the size of the individual, photoconductively-connected metallic segments 130 which collectively comprise the active area(s) of the antenna. Basic physics requires that the size of the metallic segments be no larger than about $\frac{1}{10}\lambda$ for the highest frequency supported in order not to sacrifice antenna efficiency. It is evident from the foregoing that any conductive shape, having this limited resolution, can be sequentially "projected" on the antenna surface at a rate only constrained by the time constant of the photoconductive material used to form the connections (photoconductive connectors 140) between the metallic segments 130. Thus, although the time constant for existing photoconductors is relatively high compared to many semiconductor materials, it is reasonable to assume that the connectors could be switched fast enough to reconfigure (re-pattern) the antenna at a rate of at least ten to twenty times per second. This would be sufficient to support most applications such as an airborne, ground, or sea-vehicle based satellite communications link for Communications-On-The-Move.

To complete the antenna system of the present invention, software control of the array of LEDs 160 is utilized to pattern the antenna surface 100 in response to user inputs such as frequency band, beam shape (including single or multiple beams), and pointing direction, as well as sensor feedback to correct for platform position, motion, and vibration. This problem is readily solvable using conventional software control system design, and while the element of software control is part of the present invention, the details for the implementation of any particular software control scheme is not disclosed herein.

Among the many benefits of the present invention is the apparent ease of large antenna area and large scale fabrication using established processing techniques. Unlike conventional phased array approaches, the present invention could be orders of magnitude less expensive and complex. It would also have an inherently higher modulation bandwidth, lower power consumption, and be much thinner and lighter in weight. It would thus also be very easy to make conformal to almost any curvature and be well-adapted to deployment on any airborne platform. Because these processing techniques are scalable to very small dimensions, it should also be possible to fabricate an antenna that can operate efficiently up to at least 80 GHz.

Figure 2:
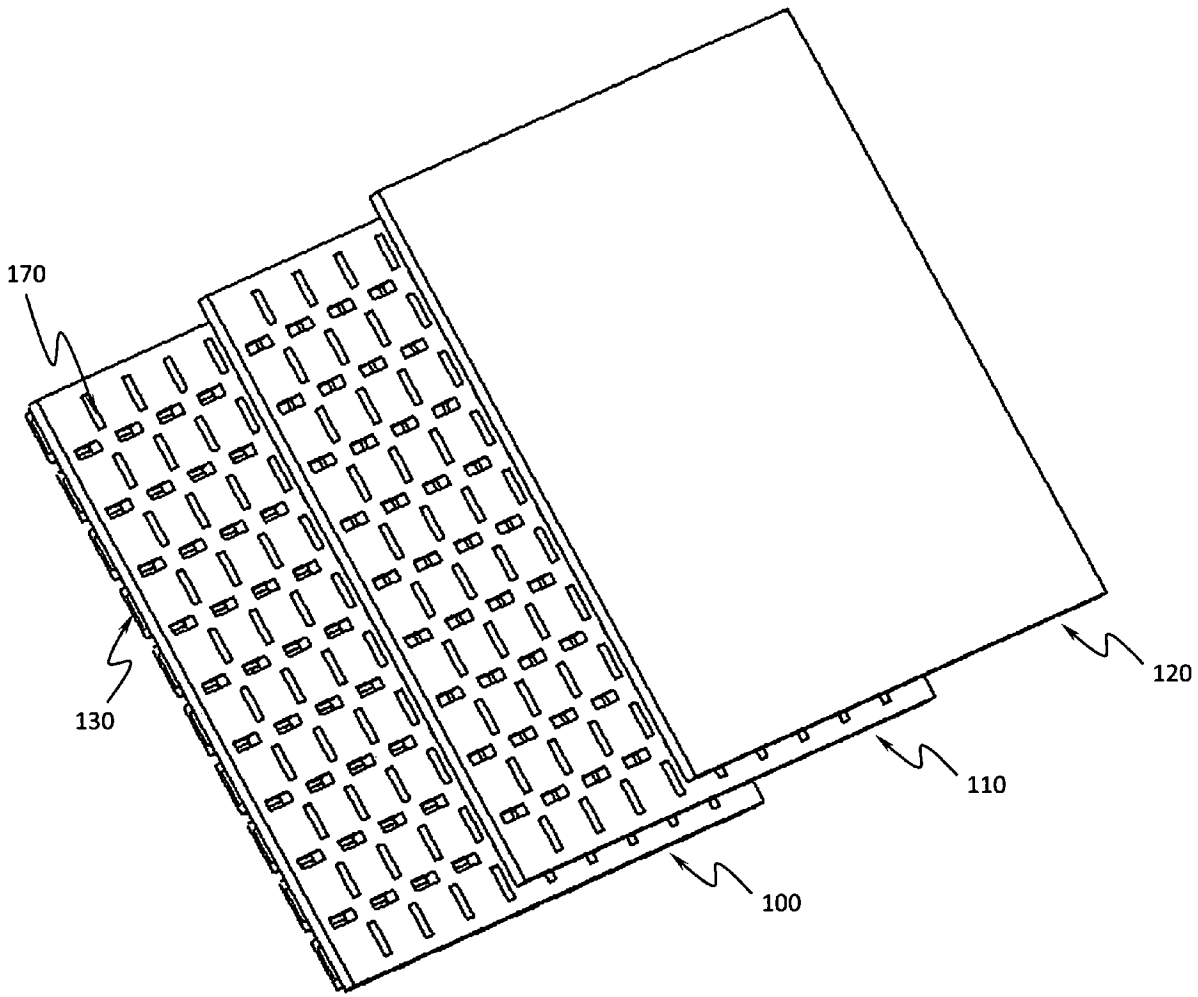
FIG. 2 depicts the three principle layers of the present invention's antenna structure as viewed from the backside non-radiating surface.

Referring to both FIG. 1 and FIG. 2, depicts a preferred embodiment of the present invention showing what could be a whole, or merely a small square portion of a large antenna implementation. The dimensions are somewhat relative only, with actual dimensions dependent on desired maximum frequency, properties of the materials employed, antenna application, and fabrication techniques used in manufacturing the antenna. Both FIG. 1 and FIG. 2 depict an assembly of three basic layers 100, 110, and 120 that comprise the antenna in the preferred embodiment. FIG. 1 depicts the invention with the RF-emitting side of the antenna 100 facing while FIG. 2 depicts the invention with the rear or non-RF emitting, LED underside coplanar array 120 facing. The three layers would be closely bonded together in the completed product, thus forming a potentially very thin and possibly very flexible, dynamically reconfigurable antenna under software control.

Again referring to FIG. 1 and FIG. 2, note first that elements 130 and 140 represent any of the metallic segments or photoconductive connector components, respectively, comprising the front (RF-emitting) surface 100 of the antenna. These are essentially deposited on to the emitting surface 100. The emitting surface 100 is a sheet of dielectric material which is either transparent to the light emitted from the LEDs 160 contained in the non-RF emitting, LED coplanar underside array 120, or alternately, perforated with a plurality of holes 170, being located to correspond to each LED 160, to allow light from each LED 160 to illuminate its corresponding photoconductive connector 140 which electrically bridges the gap between each metallic segment 130 on the RF-emitting antenna surface 100. Middle layer 110 is a metallic sheet which forms the ground plane of the antenna. The middle layer ground plane 110 contains an array of through-holes 150 being located to correspond to each LED 160 and photoconductive connector 140, to allow light from the LEDs 160 to illuminate the photoconductive connectors 140, causing an electrically conductive path to form between corresponding adjacent metallic segments 130 when given LEDs 160 are turned on by software control. The array of LEDs 160 corresponding to through-holes 150 and photoconductive connectors 140 are resident on the LED coplanar underside array 120, which is a sheet of appropriate material to contain the LEDs 160, and preferably as well as the power and control circuitry necessary to interface with software commands that create the desired lighted "antenna image pattern" on the array of LEDs 160, and thus the corresponding electrically conductive pattern from the metallic segments 130 on the radiating antenna surface 100.

A very simple example of this relationship is shown in FIG. 1, in which four metallic segments 130 comprising the upper right hand corner (shaded black) of the radiating antenna surface 100 are depicted as being melded into one electrically-continuous unit by light emitted by the four shaded black LEDs 160 shown in the upper right hand corner of the LED coplanar underside array 120, with the light passing through corresponding through holes 150 (shaded black) in the upper right hand corner of the middle layer ground plane 110, and illuminating the corresponding four photoconductive connectors 140 (not shaded) in the upper right hand corner of the radiating antenna surface 100. It is obvious that the array of LEDs 160 shown could be replaced by any light-emitting display of the appropriate spectral content and power needed to activate the photoconductive connectors 140.

Figure 3:
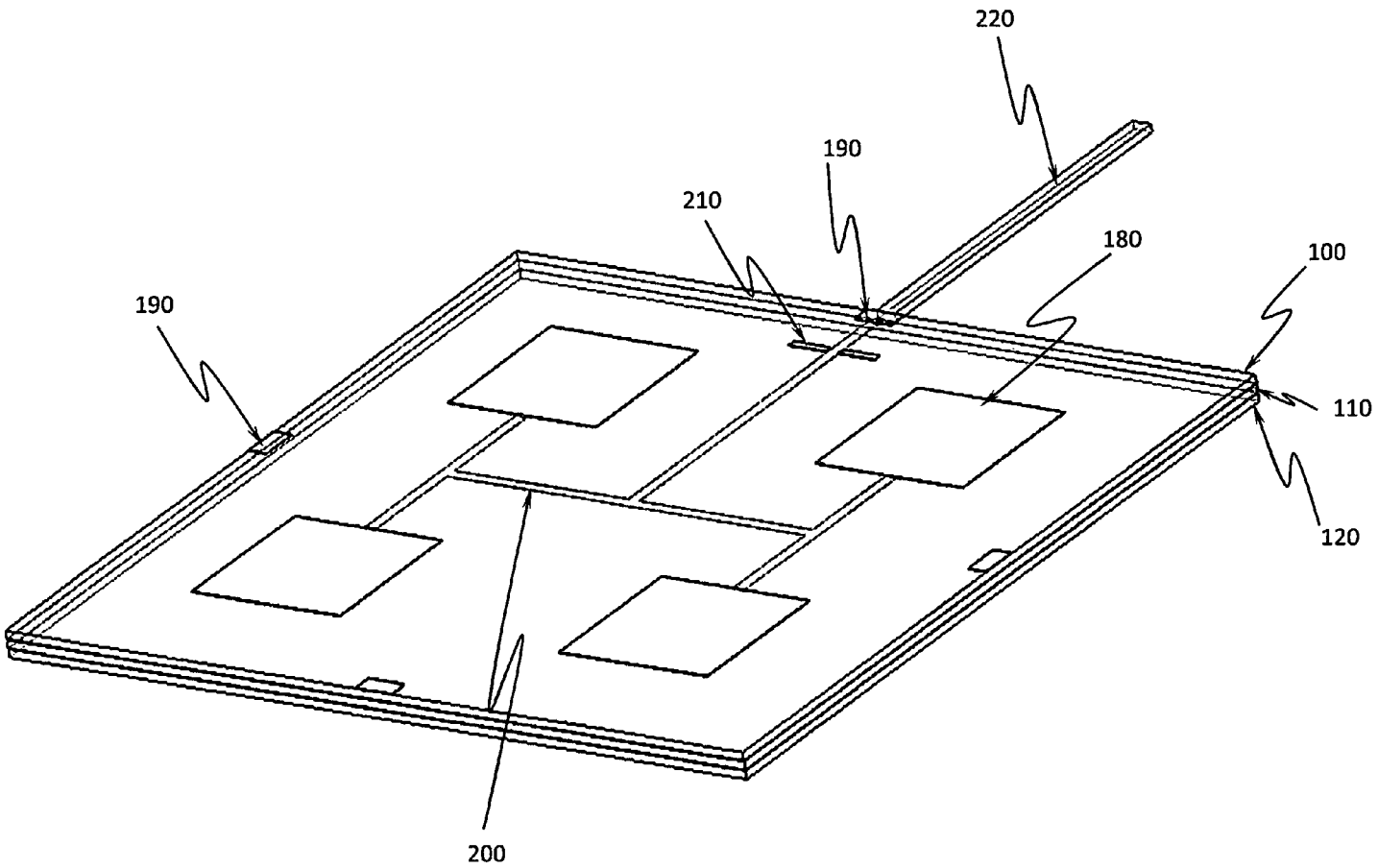
FIG. 3 depicts an embodiment of the present invention incorporating solid antenna elements, stripline feed networks, and RF feed points within a layer of the antenna structure.

Referring now to FIG. 3, in some applications of the invention, metallic segments 130 similar in composition and thickness, as well as on the same RF emitting/receiving antenna surface 100, but being typically much larger in size, and potentially of a different shape could be added for the purpose of providing for one or more solid patch antenna elements 180, RF feed points 190 for connecting external RF cable or waveguide 220 for transmitting power to the antenna, or collecting power received by the antenna, or other functions such as tuning stubs 210 for impedance matching, for example.

Additionally, it may also be advantageous or desirable to incorporate fixed electrical elements (not shown) such as surface-mounted components such as resistors, capacitors, and inductors into the antenna surface 100 for purposes such as impedance matching.

Note that the embodiment depicted in FIG. 3 shows an array of four fixed solid antenna patch elements 180 connected to an RF feed point 190 via a stripline feed network 200 comprised of a continuum of light-activated metallic segments 130 (see FIG. 1 and FIG. 2) and corresponding photoconductive connectors 140 (see FIG. 1 and FIG. 2) according to the foregoing description of the invention. Also note that the portion of the stripline feed network 200 that photoconductively connects to the RF feed point 190 also connects via adjacent photoconductive connectors 140 (see FIG. 1 and FIG. 2) on either side to tuning stub elements 210. Active tuning stub elements 210 could alternatively be dynamically formed via activation of metallic segments 130 (see FIG. 1 and FIG. 2) and photoconductive connectors 140 (see FIG. 1 and FIG. 2) that would otherwise occupy the surface area covered by fixed geometry tuning stub elements 210.

The advantages of utilizing fixed antenna patch elements 180, for example, include the higher efficiency achieved by maximizing the use of fixed geometry solid, as opposed to photoconductively and dynamically interconnectable segmented radiating elements. However, the tradeoff is that the antenna, although having the capability of electronic beam steering, would only be able to operate at the fixed center frequency dictated by the dimensions of the fixed antenna patch element 180 size.

As mentioned previously, RF feed points 190 having the correct impedance matching properties are required to couple RF energy into and out of the antenna surface 100.

Figure 4:
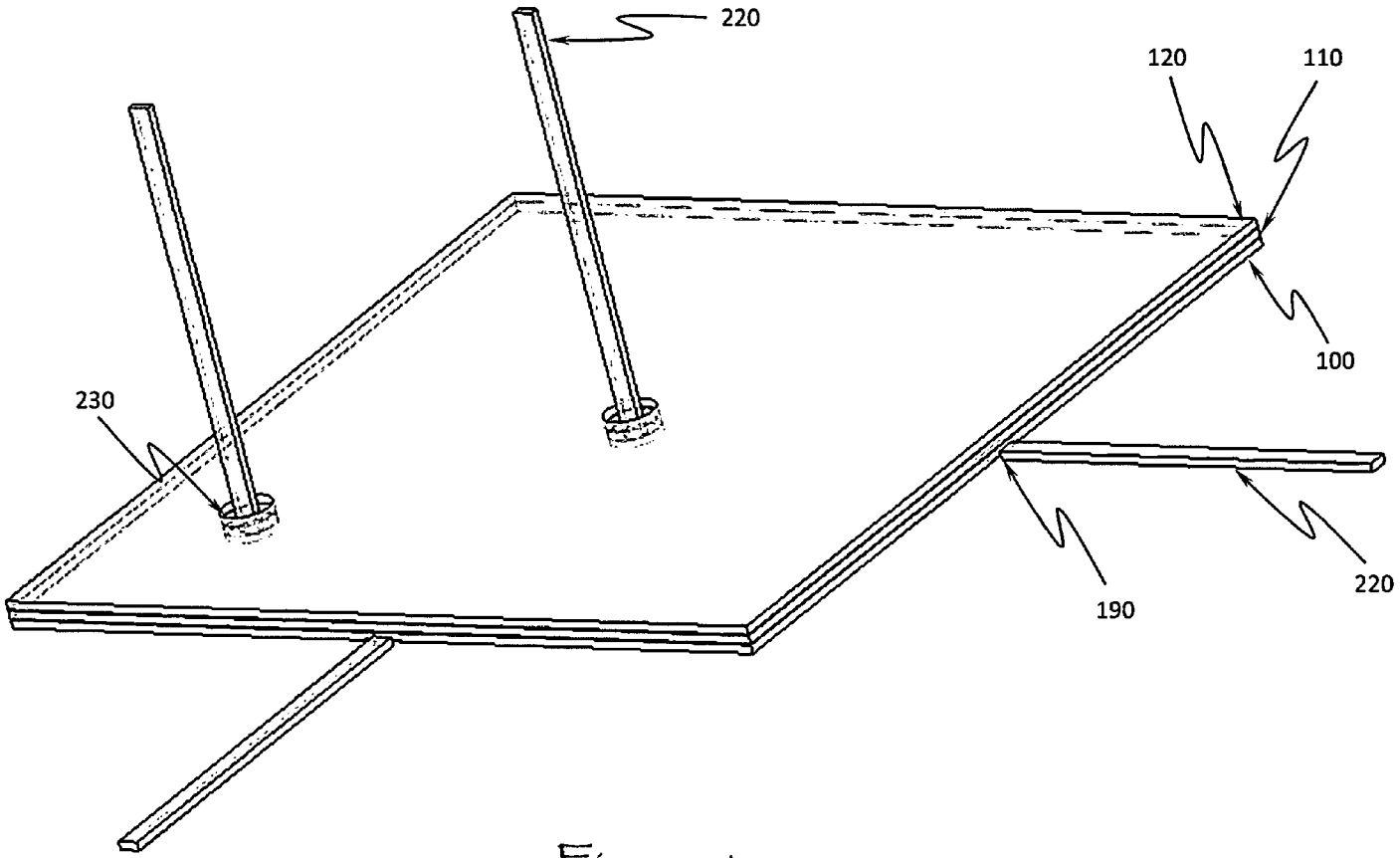
FIG. 4 depicts alternative orientations from which external RF waveguides or cables are introduced into RF feed points.

Referring to FIG. 4 illustrates possible locations where this coupling of RF energy can be accomplished, including from the edges of the front (radiating) antenna surface 100 or from the back (non-radiating layer) LED coplanar underside array 120. Note that the latter requires clearance holes 230 which transgress layers 120 and 110 to allow the external RF cable or waveguide 220 to be routed in such a way that it doesn't make contact with either of the layers 120 or 110 as it fed through to the front side of layer of antenna surface 100, where it makes appropriate electrical contact with an RF entry point connection (not shown) which is essentially the same as the RF entry point connection 190 illustrated for the aforementioned edge connection.

Figure 5:
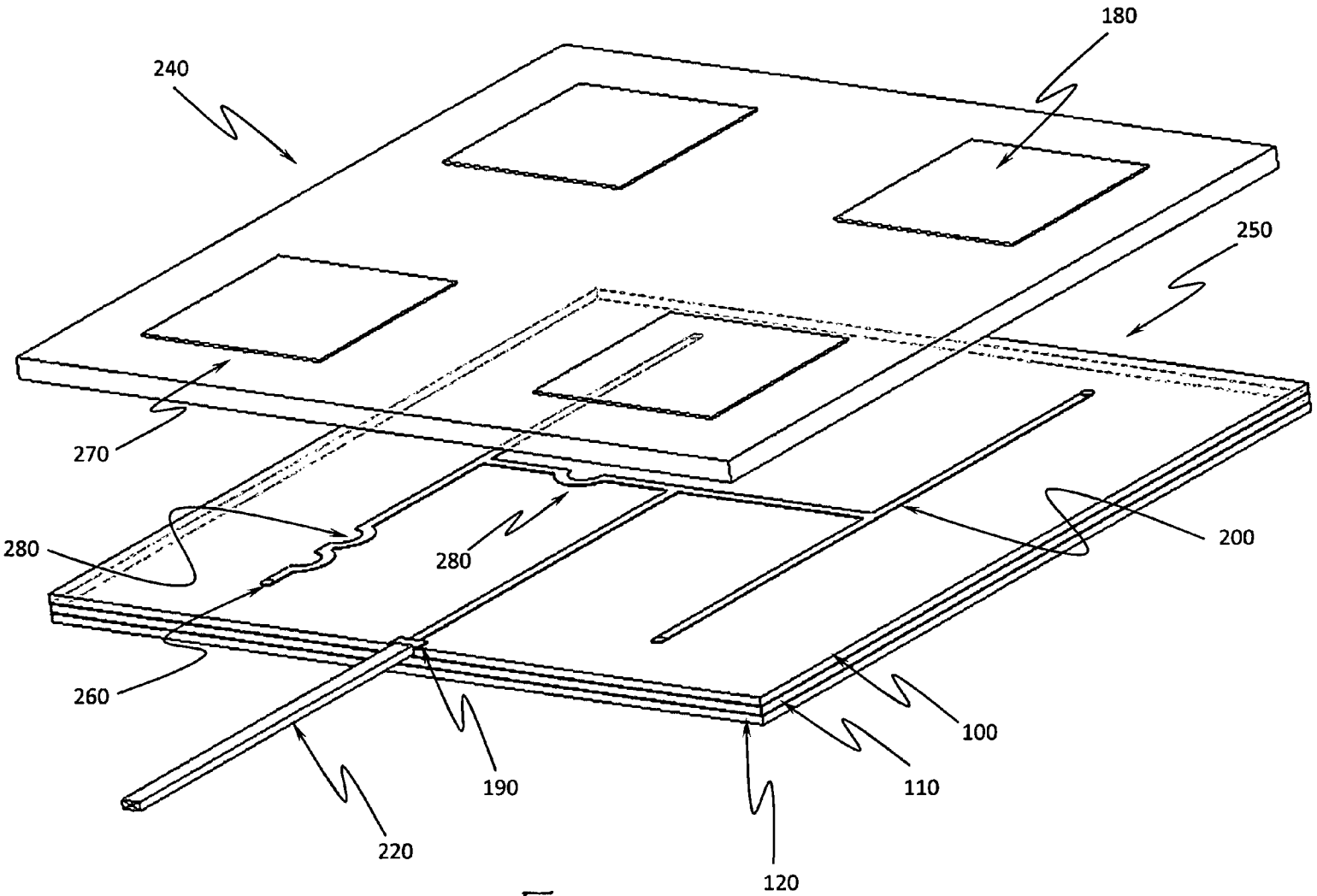
FIG. 5 depicts alternative configurations of the present invention having solid antenna patches and stripline feed networks incorporated into separate coplanar layers being interconnected by conductive paths therethrough.

Referring to FIG. 5 illustrates an alternative antenna configuration utilizing the foregoing techniques, which comprises a radiating/receiving surface antenna module 240 and a separate underlying RF feed network module 250 containing the RF feed network structure. Note that the underlying RF feed network module 250 is mandatorily constructed according to the design illustrated in FIG. 1 and FIG. 2 (not shown in detail) so that the feed network can be dynamically reconfigured to provide for software controlled antenna functions such as beam steering, as will be further described. The upper antenna module 240 could be constructed likewise, but could also be more simply comprised of one or more solid fixed antenna patch elements 180 (see also, FIG. 3). In this case, each antenna patch element 180 electrically connects to a corresponding fixed conductive pad 260 on the surface of the RF feed network module 250 through a vertical (i.e., perpendicular to the surface of antenna module 240) conductive path 270 which transgresses the total thickness of the antenna module 240. A software controlled, dynamically formed stripline feed network 200 connected to external RF transmit and/or receive RF cable or waveguide 220, which contacts the RF feed network module 250 at impedance-matched conductive entry point 190, communicates with each patch element 180 via corresponding vertical conductive paths 270. Note that the connections between each conductive pad 260 and the stripline network 200 are made via activation of the intervening photoconductive connectors 140 as described in the foregoing detailed descriptions (see FIG. 1 and FIG. 2).

Still referring to FIG. 5 depicts a simple antenna array of four solid, fixed antenna patch elements 180, but in practice could be a very dense, complex array of up to hundreds or even thousands of solid fixed antenna patch elements 180, along with a corresponding RF feed network module 250. A basic purpose of the dynamically formed stripline feed network 200 would be to dynamically vary the path lengths between the RF entry point 190 and each antenna patch element 180 to create a relative phase shift between the elements to provide for electronic (non-mechanical) beam steering of the antenna module 240 under software control. An example of a method of RF path length variation is shown in FIG. 5 as snake lines 280 dynamically generated in series with appropriate portions of the stripline feed network 200.

Note that in actual product form, the antenna module 240 and RF feed network module 250 may be bonded together to form a monolithic, relatively thin, and potentially flexible planar antenna structure. The advantage of the present system configuration of FIG. 5, in which the antenna patch elements and the RF stripline network are contained in two closely spaced parallel planes, as compared to the simpler, single plane configuration of FIG. 1 and FIG. 2, in which the antenna patch elements and RF stripline network are on the same plane, is that the former obviously allows for much denser spacing of the antenna patch elements 180 because the entire surface of the RF feed network module 250 is now available for dynamic configuration of the stripline feed network 200. This denser spacing of the antenna patch elements 180 provides for a better antenna beam pattern, with higher efficiency and much better side lobe control.

From the foregoing descriptions and accompanying drawings, it can also be seen that the invention can be implemented in a number of hybrid forms in which multiple external transmit and/or receive RF cable or waveguide feed lines 220 attached to multiple RF entry points 190 can be employed to feed individual transmit and/or receive beam patterns, or individually phase-shifted to feed individual, but cooperative subsections of the antenna system. Likewise, multiple independent antenna modules configured as in FIG. 1, FIG. 2, or FIG. 5, could be operated together so as to provide full hemispherical or greater coverage when mounted on an aircraft, for example.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a planar array antenna having a radiating layer comprising a plurality of radiating elements and tuning elements; a ground plane layer; and a control layer; a feed network comprising:

RF feed point; and a stripline feed network for connecting said RF feed points to said plurality of radiating elements and to said tuning elements, wherein said stripline feed network comprises photoconductive connectors for establishing and de-establishing electrical connectivity between said RF feed points and said plurality of radiating elements; and between said stripline feed network and any plurality of segments of said tuning elements; and wherein said photoconductive connectors for establishing and de-establishing electrical connectivity being responsive to a plurality of means comprised within said control layer for producing and transmitting a control signal.

2. Said feed network of claim 1, wherein each of said plurality of radiating elements and tuning elements comprises a conductive structure fabricated onto a substrate.

3. Said feed network of claim 1, wherein said control signal propagates through a plurality of channels within said ground plane layer.

4. Said feed network of claim 3, wherein each of said photoconductive connectors for establishing and de-establishing electrical connectivity corresponds in number and orientation to each of said plurality of channels.

5. Said feed network of claim 4 wherein said photoconductive connectors for establishing and de-establishing electrical connectivity are responsive to control signals comprising light.

6. Said feed network of claim 5, wherein each of said plurality of means for producing and transmitting a control signal further comprises light emitting diodes.

7. Said feed network of claim 6, wherein each of said plurality of means for producing and transmitting a control signal corresponds in number and orientation to each of said means for establishing and de-establishing electrical connectivity.

8. Said feed network of claim 3, wherein each of said plurality of channels further comprises means to support the transmission of light from light emitting diodes.

9. Said feed network of claim 1, wherein each of said plurality of means for producing and transmitting a control signal is responsive to computer commands, wherein said computer commands are in turn responsive to software control.

10. Said feed network of claim 1, wherein said photoconductive connectors are responsive to light from light emitting diodes.

11. Said feed network of claim 1, capable being incorporated into said planar antenna having said radiating layer, said ground plane layer, and said control layer which comprise a co-planar, vertical stack, and arranged in that respective order.

12. Said feed network of claim 1 wherein said plurality of radiating patches are electrically connected to said stripline feed network via conductive paths which transverse through said radiating layer and terminate at conductive patches on said stripline feed network.

* * * * *